US009422816B2

(12) United States Patent
Spangler et al.

(10) Patent No.: US 9,422,816 B2
(45) Date of Patent: Aug. 23, 2016

(54) AIRFOIL WITH HYBRID DRILLED AND CUTBACK TRAILING EDGE

(75) Inventors: Brandon W. Spangler, Vernon, CT (US); Sam Draper, Simpsonville, SC (US)

(73) Assignee: United Technologies Corporation, Hartford, CT (US)

( * ) Notice: Subject to any disclaimer, the term of this patent is extended or adjusted under 35 U.S.C. 154(b) by 2189 days.

(21) Appl. No.: 12/492,663

(22) Filed: Jun. 26, 2009

(65) Prior Publication Data

US 2010/0329835 A1 Dec. 30, 2010

(51) Int. Cl.
*F01D 5/18* (2006.01)

(52) U.S. Cl.
CPC ..... *F01D 5/187* (2013.01); *F01D 5/186* (2013.01); *F05D 2230/10* (2013.01); *F05D 2230/21* (2013.01); *F05D 2240/122* (2013.01); *F05D 2240/304* (2013.01); *F05D 2260/202* (2013.01); *Y10T 29/49341* (2015.01)

(58) Field of Classification Search
CPC ..... F01D 5/187; F01D 5/186; F05D 2230/21; F05D 2260/202; F05D 2230/10; F05D 2240/304; F05D 2240/122; Y10T 29/49341
USPC ..... 415/115; 416/96 R, 97 R
See application file for complete search history.

(56) References Cited

U.S. PATENT DOCUMENTS

| | | | | |
|---|---|---|---|---|
| 3,246,469 A | | 4/1966 | Moore | |
| 3,515,499 A | | 6/1970 | Beer et al. | |
| 4,153,386 A | | 5/1979 | Leogrande et al. | |
| 4,601,638 A | | 7/1986 | Hill et al. | |
| 5,203,873 A | * | 4/1993 | Corsmeier et al. | 416/96 A |
| 5,246,340 A | | 9/1993 | Winstanley et al. | |
| 5,342,172 A | | 8/1994 | Coudray et al. | |
| 5,378,108 A | | 1/1995 | Zelesky | |
| 5,458,461 A | | 10/1995 | Lee et al. | |
| 5,503,529 A | * | 4/1996 | Anselmi et al. | 416/97 R |
| 6,022,188 A | | 2/2000 | Bancalari | |
| 6,102,658 A | | 8/2000 | Kvasnak et al. | |
| 6,126,397 A | * | 10/2000 | Kvasnak et al. | 416/97 R |

(Continued)

FOREIGN PATENT DOCUMENTS

| | | |
|---|---|---|
| JP | 2003056301 A | 2/2003 |
| WO | WO94/12771 A1 | 6/1994 |

OTHER PUBLICATIONS

M.E. Taslim et al., "An Experimental Investigation of Film Cooling Effectiveness for Slots of Various Exit Geometries", AIAA-90-2266, AIAA/SAE/ASME/ASEE 26th Joint Propulsion Conference, Jul. 16-18, 1990 (8 pages).

(Continued)

*Primary Examiner* — Dwayne J White
*Assistant Examiner* — Aaron R Eastman
(74) *Attorney, Agent, or Firm* — Kinney & Lange, P.A.

(57) ABSTRACT

An apparatus for a gas turbine engine includes an airfoil, a metering opening for metering a cooling fluid, a cutback slot configured to deliver the cooling fluid from the metering opening, and a cooling hole. The airfoil defines a trailing edge, opposite first and second faces, and a mean camber line. The cutback slot is defined along the first face of the airfoil adjacent to the trailing edge and offset from the mean camber line of the airfoil. The cooling hole has an outlet that is located at the trailing edge and substantially aligned with the mean camber line of the airfoil. The cooling hole delivers a portion of the cooling fluid from the metering opening.

19 Claims, 6 Drawing Sheets

(56) References Cited

U.S. PATENT DOCUMENTS

| | | | | |
|---|---|---|---|---|
| 6,129,515 | A | 10/2000 | Soechting et al. | |
| 6,179,565 | B1 | 1/2001 | Palumbo et al. | |
| 6,241,466 | B1 * | 6/2001 | Tung et al. | 415/115 |
| 6,325,593 | B1 * | 12/2001 | Darkins et al. | 415/115 |
| 6,422,819 | B1 | 7/2002 | Tsai et al. | |
| 6,499,949 | B2 | 12/2002 | Schafrik et al. | |
| 6,520,836 | B2 * | 2/2003 | Dean et al. | 451/28 |
| 7,371,048 | B2 * | 5/2008 | Downs et al. | 416/97 R |
| 7,438,528 | B2 | 10/2008 | Goodman et al. | |
| 7,985,050 | B1 | 7/2011 | Liang | |
| 8,052,392 | B1 | 11/2011 | Liang | |
| 2006/0039787 | A1 * | 2/2006 | Goodman et al. | 416/97 R |
| 2007/0237639 | A1 * | 10/2007 | Cunha et al. | 416/97 R |
| 2008/0031738 | A1 * | 2/2008 | Lee | 416/97 R |
| 2010/0040480 | A1 * | 2/2010 | Webster et al. | 416/97 R |
| 2010/0068067 | A1 * | 3/2010 | Liang | 416/97 R |

OTHER PUBLICATIONS

Extended European Search Report from EP Application Serial No. 10251168.0; dated Apr. 23, 2014; 6 pages.

* cited by examiner

AIRFOIL WITH HYBRID DRILLED AND CUTBACK TRAILING EDGE

STATEMENT OF GOVERNMENT INTEREST

The present invention was developed, at least in part, with government funding pursuant to Contract No. N00019-02-C-3003 awarded by the United States Navy. The U.S. Government may have certain rights in this invention.

BACKGROUND

The present invention relates to fluid-cooled airfoils, and more particularly to fluid-cooled airfoils suitable for use with gas turbine engines.

Airfoils, such as those used in gas turbine engines, often operate in relatively hot environments. In order to help ensure air foil integrity, airfoils can utilize high temperature alloys, thermal barrier coatings, and cooling fluid delivery. However, known cooling schemes may be inadequate for some desired applications. Inadequate cooling fluid delivery can lead to spallation of coatings, and other wear or damage to the airfoil (e.g., crack formation), which may necessitate repair or replacement of the airfoil. Such a need for repair or replacement of an airfoil is costly and time-consuming. Therefore, it is desired to provide for improved fluid cooling for an airfoil, particularly at a trailing edge of the airfoil.

SUMMARY

An apparatus according to the present invention for use with a gas turbine engine includes an airfoil, a metering opening for metering a cooling fluid, a cutback slot configured to deliver the cooling fluid from the metering opening, and a cooling hole. The airfoil defines a trailing edge, opposite first and second faces, and a mean camber line. The cutback slot is defined along the first face of the airfoil adjacent to the trailing edge and is offset from the mean camber line of the airfoil. The cooling hole has an outlet that is located at the trailing edge and substantially aligned with the mean camber line of the airfoil. The cooling hole delivers a portion of the cooling fluid from the metering opening.

DETAILED DESCRIPTION

In general, the present invention relates to a fluid-cooled airfoil having a film-cooling cutback slot located along a pressure face adjacent to the trailing edge and a convective-cooling hole extending to the trailing edge. A cooling fluid from a plenum is metered through a metering opening, and passes to the cutback slot to provide film cooling. A portion of the cooling fluid delivered to the cutback slot is directed through the cooling hole extending to the trailing edge to provide convective cooling to the airfoil. In that way, hybrid film cooling and convective cooling is provided at or near the trailing edge, which can help maintain regions of the trailing edge of the airfoil at or below suitable thermal operating limits. In one embodiment, an inlet of the hole extending to the trailing edge is located at or downstream from an upstream boundary of the cutback slot along the pressure face of the airfoil, and an outlet of the hole extending to the trailing edge is substantially aligned with a mean camber line of the airfoil.

Figure 1:
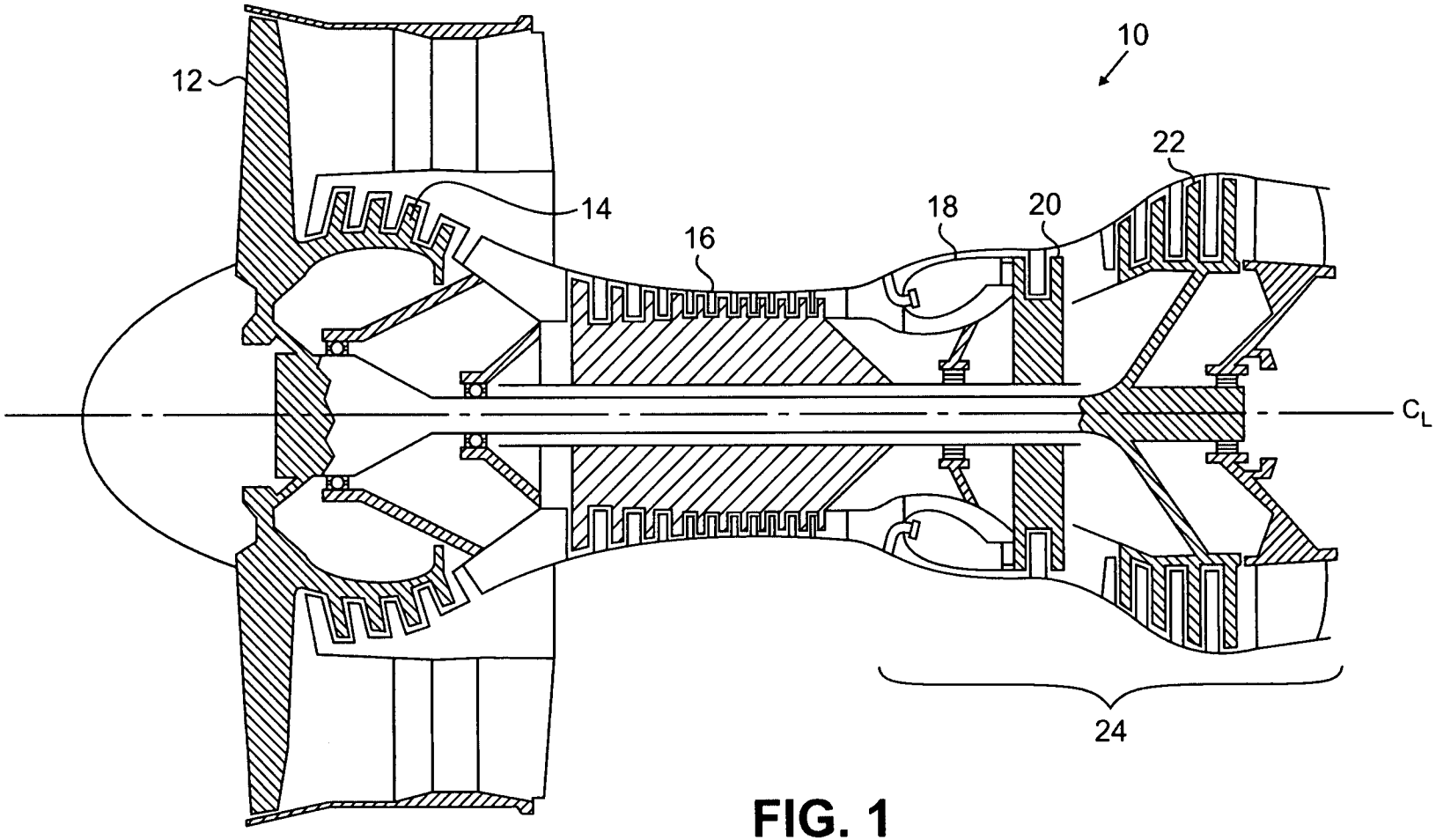
FIG. 1 is a schematic cross-sectional view of a gas turbine engine.

FIG. 1 is a schematic cross-sectional view of a gas turbine engine 10 that includes a fan section 12, a low-pressure compressor (LPC) section 14, a high-pressure compressor (HPC) section 16, a combustor section 18, a high-pressure turbine (HPT) section 20, and a low-pressure turbine (LPT) section 22. A centerline $C_L$ is defined by the engine 10. A hot section 24 of the engine 10 is generally defined from the combustor section 18 afterward, including the HPT section 20 and the LPT section 22. The illustrated embodiment of the gas turbine engine 10 is provided merely by way of example, and it should be recognized that the present invention applies to gas turbine engines of any configuration, such as low bypass ratio configurations. Those of ordinary skill in the art will understand the basic operation of gas turbine engines, and therefore further discussion here is unnecessary.

Figure 2:
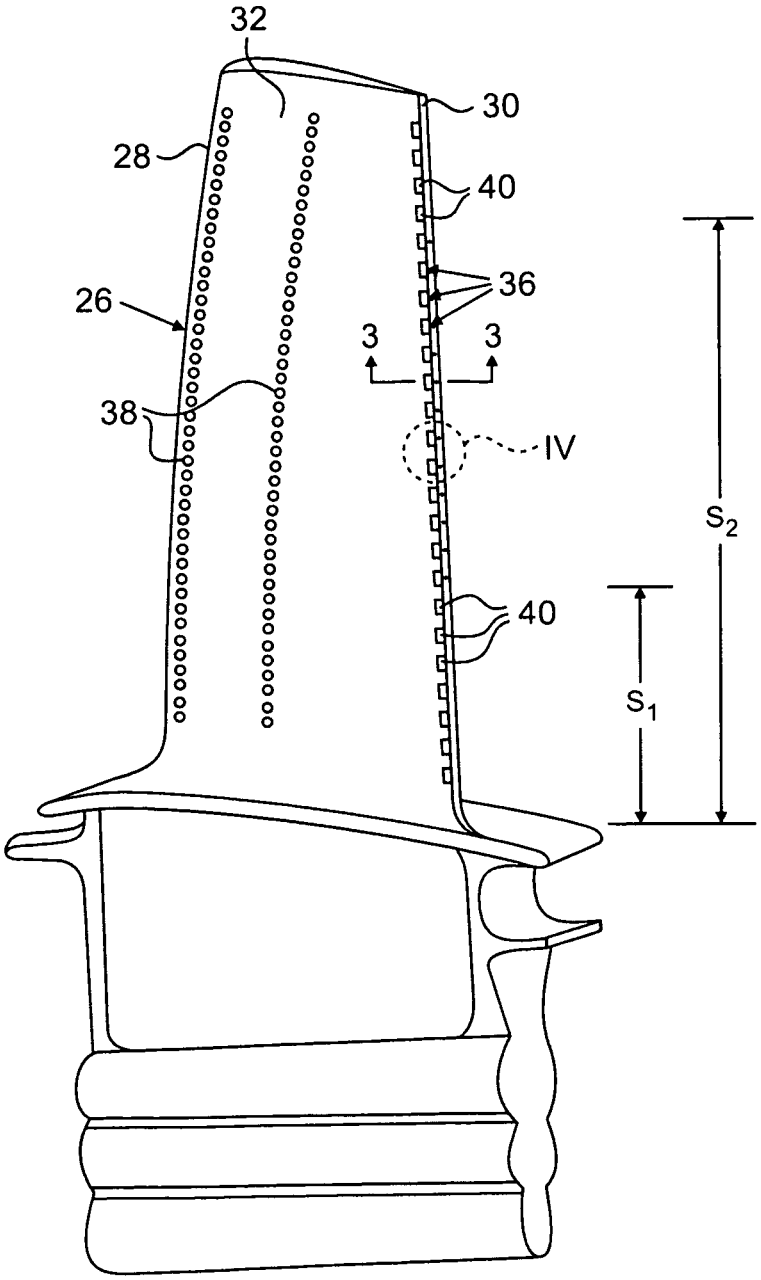
FIG. 2 is a perspective view of an airfoil according to the present invention.

FIG. 2 is a perspective view of an airfoil 26 that defines a leading edge 28, a trailing edge 30 downstream of the leading edge 28, a pressure face 32, and a suction face 34 (not visible in FIG. 2; see FIG. 3) located opposite the pressure face 32. The airfoil 26 is suitable for use in the hot section 24 of the gas turbine engine 10, and can be configured as either a blade or a stator. The airfoil 26 includes a plurality of cooling passages 36 at or near the trailing edge 30. Additional cooling openings 38 of a known configuration can optionally be provided at upstream portions of the airfoil 26. As shown in the illustrated embodiment, the cooling passages 36 are spaced apart ene from each other in a spanwise direction, and are located within a region defined between spanwise locations $S_1$ and $S_2$. In one embodiment, the spanwise location $S_1$ is at approximately 30% of a span of the airfoil 26 and the spanwise location $S_2$ is at approximately 70-80% of the span of the airfoil 26. The region defined between spanwise locations $S_1$ and $S_2$ can be selected to cover relatively high-temperature regions of the airfoil 26 near the trailing edge 30. Moreover, limiting the region defined between spanwise locations $S_1$ and $S_2$ can help promote structural integrity of the airfoil 26 by omitting the cooling passages 36 at relatively high stress regions of the airfoil 26 (e.g., near a platform and tip). As shown in the illustrated embodiment, additional cutback slots 40 are located at the pressure face 32 adjacent to the trailing edge 30 at locations outside the region defined between spanwise locations $S_1$ and $S_2$. It should be noted that the airfoil 26 can include a platform and a root, and in further embodiments can optionally include other features not specifically shown or described, such as a shroud.

Figure 3:
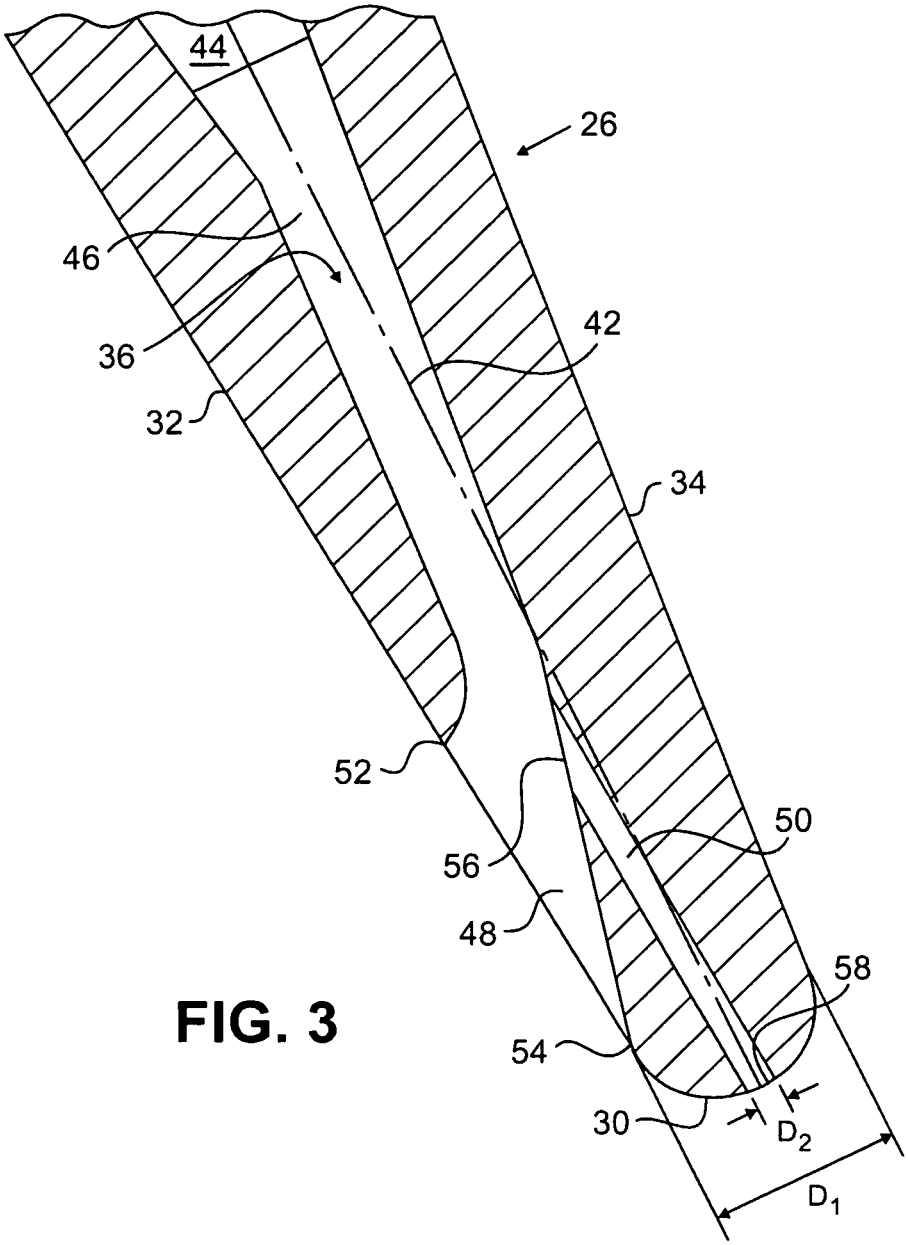
FIG. 3 is a cross-sectional view of a portion of the airfoil, taken along line 3-3 of FIG. 2.

FIG. 3 is a cross-sectional view of a portion of the airfoil 26, taken along line 3-3 of FIG. 2. As shown in FIG. 3, a mean camber line 42 defines the mean thickness of the airfoil 26 between the pressure face 32 and the suction face 34. In the illustrated embodiment, the trailing edge 30 is radiused, and has a diameter $D_1$. A plenum 44 extends in at least partially in the spanwise direction inside the airfoil 26 for supplying a cooling fluid (e.g., bleed air). The plenum 44 can have a known configuration, and can act as a manifold to supply the cooling fluid to a number of cooling passages at various locations on the airfoil 26.

Each of the cooling passages 36 (one is shown in FIG. 3) includes a metering opening 46, a cutback slot 48, and a trailing edge cooling hole 50. The metering opening 46 is fluidically connected to the plenum 44 to receive and meter cooling flows. The cutback slot 48 is located downstream from the metering opening 46, and is configured to deliver cooling fluid to the pressure face 32 at an outlet defined between an upstream boundary 52 and a downstream boundary 54. The downstream boundary 54 of the cutback slot 48 is located adjacent to and slightly upstream from the trailing edge 30. The cutback slot 48 is generally offset from the mean camber line 42. Additional details of the cutback slot 48 are discussed below.

The trailing edge cooling hole 50 extends from the cutback slot 48 to the trailing edge 30, between an inlet 56 and an outlet 58. In the illustrated embodiment, the inlet 56 of trailing edge cooling hole 50 is located essentially within the cutback slot 48, that is, the inlet 56 is located approximately at or downstream of the upstream boundary 52 of the cutback slot 48 and at or upstream of the downstream boundary 54. Furthermore, in the illustrated embodiment, the outlet 58 of the trailing edge cooling hole 50 is substantially aligned with the mean camber line 42 at the trailing edge 30. The outlet 58 and other portions of the trailing edge cooling hole 50 has a substantially circular cross-section in the illustrated embodiment. In alternative embodiments, other shapes of the outlet 58 are possible, such as an elliptical or "racetrack" shape with a major axis arranged in the spanwise direction. The outlet 58 has a diameter (or width) $D_2$. In one embodiment, the diameter $D_1$ of the trailing edge 30 is at least approximately three times larger than the diameter $D_2$ of the outlet 58. Having the diameter $D_1$ significantly larger than the diameter $D_2$ helps promote structural integrity of the trailing edge 30.

Although in the illustrated embodiment only a single trailing edge cooling hole 50 extends from each cutback slot 48, in further embodiments multiple trailing edge cooling holes 50 can extend from a given cutback slot 48. For example, multiple trailing edge cooling holes 50 can extend from a given cutback slot 48 at different angles relative to the centerline $C_L$ and each have separate inlets 56. Alternatively, multiple trailing edge cooling holes 50 extending from a given cutback slot 48 could share a common inlet 56.

Figure 4:
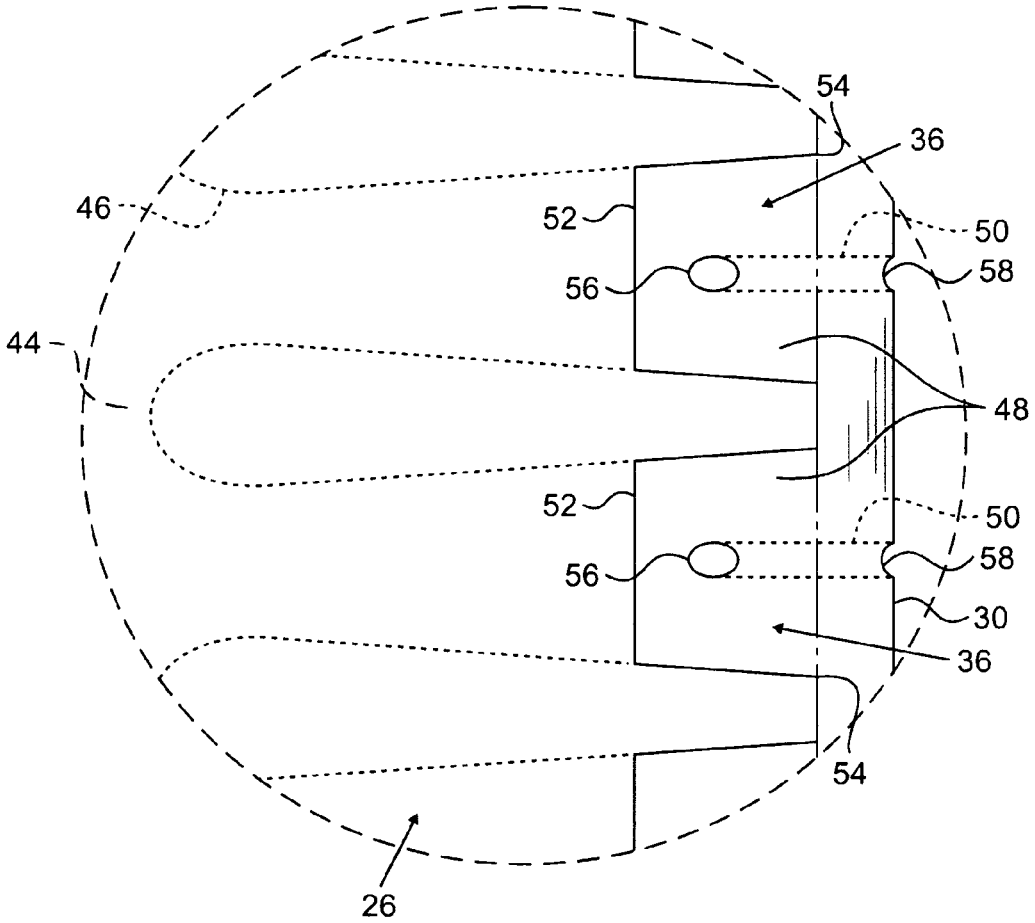
FIG. 4 is an enlarged view of a portion of the airfoil, showing region IV of FIG. 2.

FIG. 4 is an enlarged view of a portion of the airfoil 26, showing region IV of FIG. 2. In the embodiment illustrated in FIG. 4, the cutback slots 48 each have a diverging shape at their respective outlets. The cutback slots 48 each define an outlet area that is substantially larger than that of either the inlet 56 or the outlet 58 of the corresponding trailing edge cooling hole 50. Furthermore, as shown in FIG. 4, the cooling passages 36 extend substantially axially with respect to the centerline $C_L$ of the engine 10, and the trailing edge cooling holes 50 are each substantially aligned with a corresponding one of the cutback slots 48 at a given spanwise location. In alternative embodiments, the cooling passages 36 can have different orientations as desired for particular applications. For example, in an alternative embodiment the cutback slot 48 and the trailing edge cooling hole 50 of any of the cooling passages 36 can extend at different angles with respect to the centerline $C_L$.

Figure 5:
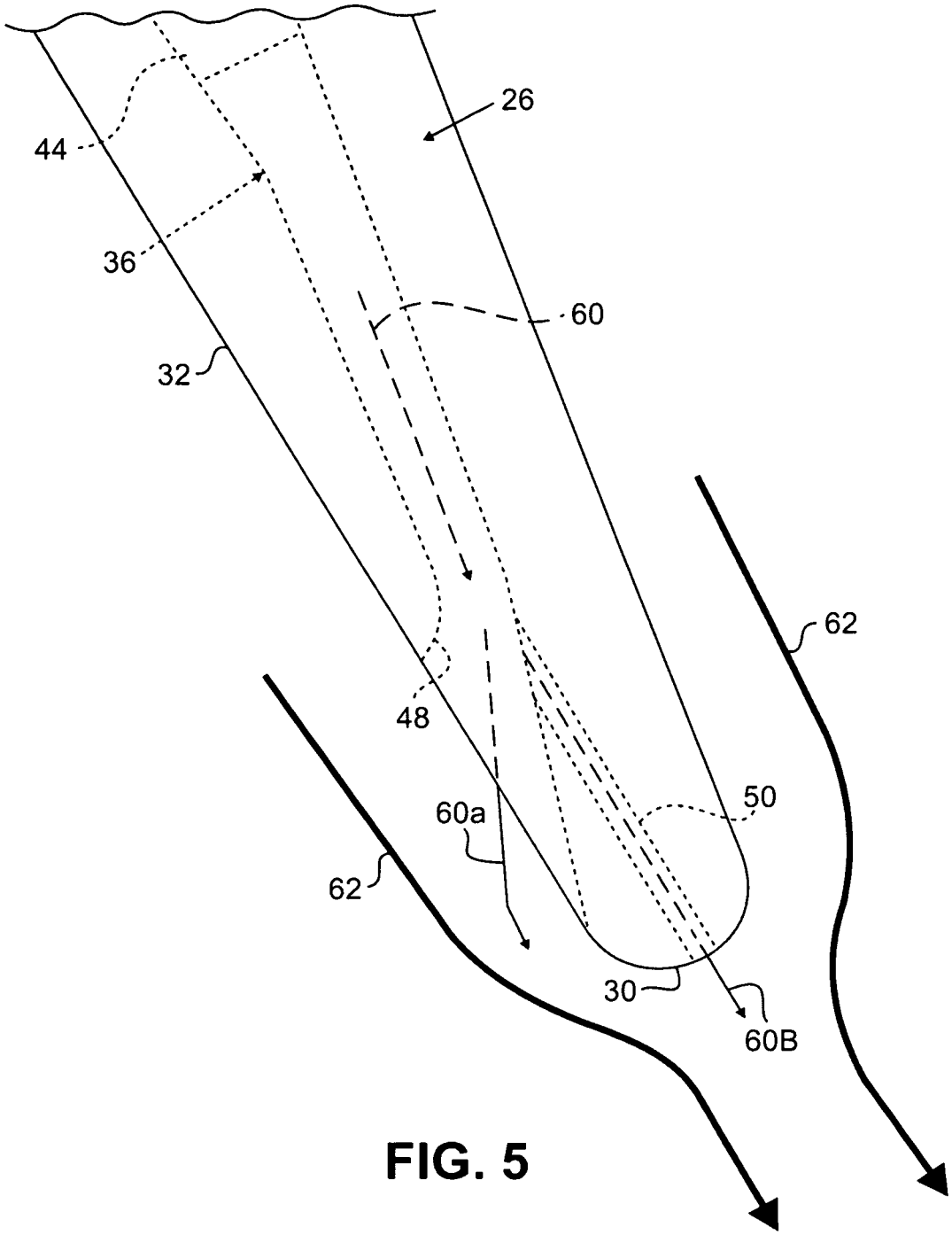
FIG. 5 is a schematic view of the airfoil, showing cooling flow and hot gas flow.

FIG. 5 is a schematic view of the airfoil 26, showing a cooling fluid flow 60 and hot gas flows 62. During operation, the hot gas flows 62 pass along the pressure face 32 and the suction face 34 of the airfoil 26, and continue past the trailing edge 30. The relatively cool cooling fluid flow 60 is supplied by the plenum 44 to the cooling passages 36 (only one cooling passage 36 is shown in FIG. 5). The cooling fluid flow 60 is delivered to the cutback slot 48, and a first portion 60A of the cooling fluid flow 60 is exhausted from the cutback slot 48 at the pressure face 32 of the airfoil 26 to provide film cooling at or near the trailing edge 30. Film cooling tends to create a layer of relatively cool fluid between the hot gas flows 62 and surfaces of the airfoil 26 in order to help keep the airfoil 26 cool. A second portion 60B of the cooling fluid flow 60 is delivered by the trailing edge cooling hole 50, and the second portion 60B is diverted from the cutback slot 48 and exhausted from the trailing edge 30 to provide convective cooling at or near the trailing edge 30. Convective cooling allows thermal energy from the airfoil 26 to be absorbed by the cooling fluid flow 60 and thereby removed and exhausted to the hot gas flows 62.

The second portion 60B of the cooling fluid flow 60 also provides aerodynamic benefits by helping to straighten fluid flows at or near the trailing edge 30 of the airfoil 26. Moreover, by exhausting the second portion 60B of the cooling fluid flow 60 at the trailing edge 30 along the mean camber line 42, the relatively high mixing losses typically associated with pressure face and suction face cooling flows are avoided.

Figure 6:
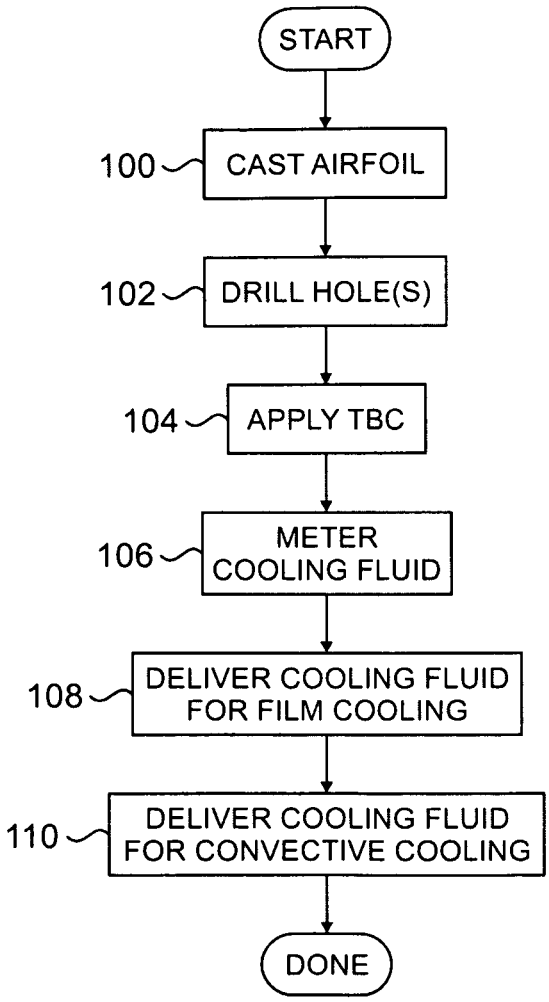
FIG. 6 is a flow chart of a method of making and using an airfoil according to the present invention.

FIG. 6 is a flow chart of a method of making and using the airfoil 26. First, the airfoil 26 is created using a casting process (step 100). During casting, one or more of cutback slots 48 are defined, which can be accomplished using casting cores in a known manner. After the cutback slots 48 are defined, one or more trailing edge cooling holes 50 are drilled in the airfoil 26 (step 102). Drilling can be performed using electric discharge machining (EDM), laser drilling, or other suitable processes. When multiple trailing edge cooling holes 50 are desired, they can be drilled simultaneously or sequentially. A thermal barrier coating (TBC) is also applied to the airfoil 26 (step 104). In one embodiment, the TBC is applied subsequent to drilling of the trailing edge cooling holes. However, with some drilling methods, such as laser drilling, the TBC could alternatively be applied prior to drilling. Furthermore, in some embodiments, use of the TBC can be omitted entirely. Lastly, for each cooling passage 36, a cooling fluid is supplied and metered when the airfoil 26 is in operation (step 106), and the metered cooling fluid is delivered to the cutback slot 48 to provide film cooling (step 108). A portion of the cooling fluid delivered to the cutback slot 48 is diverted for delivery by the trailing edge cooling holes 50 (step 110).

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims. For example, the present invention can be utilized in conjunction with any number of additional cooling features, such as additional cooling passages of a known configuration. Moreover, trailing edge cooling holes can be drilled into existing airfoils with cutback slots as part of a repair or retrofit operation according to the present invention.

The invention claimed is:

1. An apparatus for a gas turbine engine, the apparatus comprising:

an airfoil defining a trailing edge, opposite first and second faces, and a mean camber line;

a metering opening for metering a cooling fluid;

a cutback slot configured to deliver the cooling fluid from the metering opening, the cutback slot defined along the first face of the airfoil adjacent to the trailing edge and offset from the mean camber line of the airfoil; and a cooling hole having an outlet that is located at the trailing edge and substantially aligned with the mean camber line of the airfoil, wherein the cooling hole delivers a portion of the cooling fluid from the metering opening, wherein the cutback slot defines an upstream boundary at the first face of the airfoil, and wherein the cooling hole defines an inlet located at or downstream from the upstream boundary of the cutback slot.

2. The apparatus of claim 1, and further comprising:

a cooling fluid supply plenum extending at least partially in a spanwise direction through an interior portion of the airfoil, the cooling fluid supply plenum configured to supply the cooling fluid to the metering opening for both the cutback slot and the cooling hole.

3. The apparatus of claim 1, wherein the cutback slot has a diverging shape.

4. The apparatus of claim 1, wherein the cooling hole extends in a chordwise direction.

5. The apparatus of claim 1, wherein the trailing edge is radiused.

6. The apparatus of claim 5, wherein the trailing edge defines a first diameter and the cooling hole defines a second diameter, and wherein the first diameter is at least three times greater than the second diameter.

7. The apparatus of claim 1, wherein the cooling hole and the cutback slot are substantially aligned in a spanwise direction along the airfoil.

8. The apparatus of claim 1, wherein an outlet area of the cutback slot is larger than an area of the outlet of the cooling hole.

9. The apparatus of claim 1, wherein the first face is a pressure face and the second face is a suction face.

10. A method comprising:

casting an airfoil, wherein casting defines a cutback slot at a pressure side of the airfoil adjacent to a trailing edge of the airfoil; and removing material of the airfoil subsequent to casting to define a cooling hole from the cutback slot to the trailing edge of the airfoil.

11. The method of claim 10, wherein removing material of the airfoil to define the cooling hole comprises drilling.

12. The method of claim 10, wherein a plurality of spaced apart cutback slots are defined during the casting step.

13. The method of claim 12, wherein a plurality of cooling holes are defined during the step of removing material of the airfoil, each of the plurality of cooling holes defined relative to one of the plurality of spaced apart cutback slots.

14. The method of claim 10 and further comprising:

providing a cooling fluid;

delivering at least a portion of the cooling fluid through the cutback slot; and delivering at least some of the cooling fluid from the cutback slot through the cooling hole.

15. An airfoil comprising:

a pressure face;

a suction face located opposite the pressure face;

a mean camber line defined midway between the pressure and suction faces;

a trailing edge substantially aligned with the mean camber line;

a plurality of trailing edge cooling passages spaced from one another in a spanwise direction, wherein each of the trailing edge cooling passages comprises:

a first portion that defines an outlet arranged along the pressure face of the airfoil, wherein the outlet of the first portion is configured as a cutback slot to provide film cooling; and a second portion that defines an outlet at the trailing edge, the outlet of the second portion substantially aligned with the mean camber line to provide convective cooling, wherein the outlet of the first portion is larger than the outlet of the second portion.

16. The airfoil of claim 15, wherein the plurality of trailing edge cooling passages having the second portion are located exclusively in a region between 30% to 80% of a span of the airfoil.

17. The apparatus of claim 15, wherein the outlet of the cutback slot defines an upstream boundary at the pressure face of the airfoil, and wherein the inlet of the second portion is located at or downstream from the upstream boundary of the outlet of the cutback slot.

18. The airfoil of claim 15, wherein the trailing edge is radiused and defines a first diameter, wherein the outlet of the second portion defines a second diameter, and wherein the first diameter is at least three times greater than the second diameter.

19. A method comprising:

delivering a cooling fluid to a cutback slot at a pressure face of an airfoil adjacent to a trailing edge of the airfoil to provide film cooling; and delivering a portion of the cooling fluid from the cutback slot where film cooling is provided through the trailing edge of the airfoil to provide convective cooling.

* * * * *